US010177502B2

(12) United States Patent
Zhao

(10) Patent No.: US 10,177,502 B2
(45) Date of Patent: Jan. 8, 2019

(54) ELECTRICAL CONNECTOR HAVING A MATING TONGUE AND A GROUND CONTACT WITH AN EXTENSION EXPOSED TO THE TONGUE

(71) Applicant: FOXCONN INTERCONNECT TECHNOLOGY LIMITED, Grand Cayman (KY)

(72) Inventor: Jun Zhao, Huaian (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/851,586

(22) Filed: Dec. 21, 2017

(65) Prior Publication Data

US 2018/0175555 A1 Jun. 21, 2018

(30) Foreign Application Priority Data

Dec. 21, 2016 (CN) ..... 2016 1 1189228

(51) Int. Cl.

| | |
|---|---|
| ***H01R 24/00*** | (2011.01) |
| ***H01R 13/6471*** | (2011.01) |
| ***H01R 13/506*** | (2006.01) |
| ***H01R 13/405*** | (2006.01) |

(52) U.S. Cl.

CPC ..... *H01R 13/6471* (2013.01); *H01R 13/405* (2013.01); *H01R 13/506* (2013.01)

(58) Field of Classification Search

CPC ..... H01R 23/6873; H01R 23/7073; H01R 23/7063; H01R 23/725; H01R 23/688; H01R 13/658

USPC ..... 439/607.35, 0.4, 660, 108

See application file for complete search history.

(56) References Cited

U.S. PATENT DOCUMENTS

| | | | | |
|---|---|---|---|---|
| 6,623,300 | B2 * | 9/2003 | Sakurai | H01R 13/6583 439/607.25 |
| 7,008,267 | B2 * | 3/2006 | Fan | H01R 13/658 439/607.35 |
| 7,686,628 | B2 * | 3/2010 | Lino | H01R 43/0256 439/108 |
| 8,506,332 | B2 * | 8/2013 | Sommers | H01R 12/725 439/607.32 |
| 8,545,240 | B2 | 10/2013 | Casher et al. | |
| 9,484,679 | B2 | 11/2016 | Guo et al. | |
| 2015/0244111 | A1 | 8/2015 | Ju et al. | |
| 2015/0295362 | A1 | 10/2015 | Tziviskos et al. | |

FOREIGN PATENT DOCUMENTS

| | | |
|---|---|---|
| CN | 104810657 | 7/2015 |
| CN | 105024197 | 11/2015 |
| TW | M526206 | 7/2016 |

* cited by examiner

*Primary Examiner* — Hien Vu
(74) *Attorney, Agent, or Firm* — Wei Te Chung; Ming Chieh Chang

(57) ABSTRACT

An electrical connector includes: an insulative housing having a base and a tongue; an upper and lower rows of contacts secured to the housing and exposed respectively to an upper and lower surfaces of the tongue, each row of contacts including two outermost ground contacts; and a shielding shell enclosing the contact module; wherein at least one of the ground contacts in one or both rows of the contacts has an extension, and the tongue has on at least one of the upper and lower surfaces a step exposing the extension.

5 Claims, 16 Drawing Sheets

ELECTRICAL CONNECTOR HAVING A MATING TONGUE AND A GROUND CONTACT WITH AN EXTENSION EXPOSED TO THE TONGUE

BACKGROUND OF THE INVENTION

1. Field of the Invention

The present invention relates to an electrical connector having an outermost ground contact with an integral extension exposed to a tongue thereof for contacting a grounding piece of a mating connector for grounding purpose.

2. Description of Related Art

Taiwan Patent No. M526206 discloses a dual-orientation electrical connector comprising an insulative housing, an upper and lower rows of contacts secured to the housing, and a shielding shell enclosing the housing. One row of contacts include two outermost ground contacts each having a respective integral piece positioned essentially between the upper row of contacts and the lower row of contacts.

SUMMARY OF THE INVENTION

An electrical connector comprises: an insulative housing having a base and a tongue; an upper and lower rows of contacts secured to the housing and exposed respectively to an upper and lower surfaces of the tongue, each row of contacts including two outermost ground contacts; and a shielding shell enclosing the contact module; wherein at least one of the ground contacts in one or both rows of the contacts has an extension, and the tongue has on at least one of the upper and lower surfaces a step exposing the extension.

DETAILED DESCRIPTION OF THE PREFERRED EMBODIMENT

Figure 1:
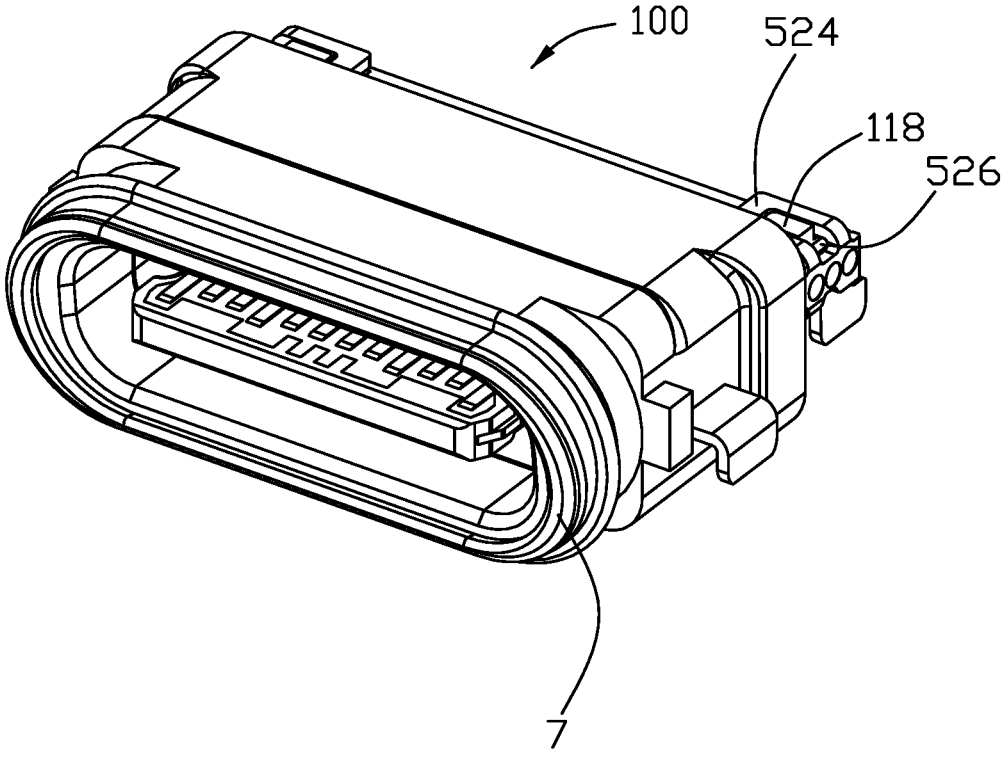
FIG. 1 is a perspective view of an electrical connector in accordance with a first embodiment of the present invention.

Referring to FIGS. 1 to 12, an electrical connector 100 comprises an insulative housing 1, an upper row of contacts 21 and a lower row of contacts 22 secured to the insulative housing 1, and a shielding shell 4 enclosing the insulative housing 1. The electrical connector 100 may further include a pair of metal pieces 3 secured in the insulative housing 1 between the upper row of contacts 21 and the lower row of contacts 22, an insulative outer cover 5 enclosing the shielding shell 4, a rear sealing member 6, and a sealing member 7 secured to the outer cover 5.

Figure 9:
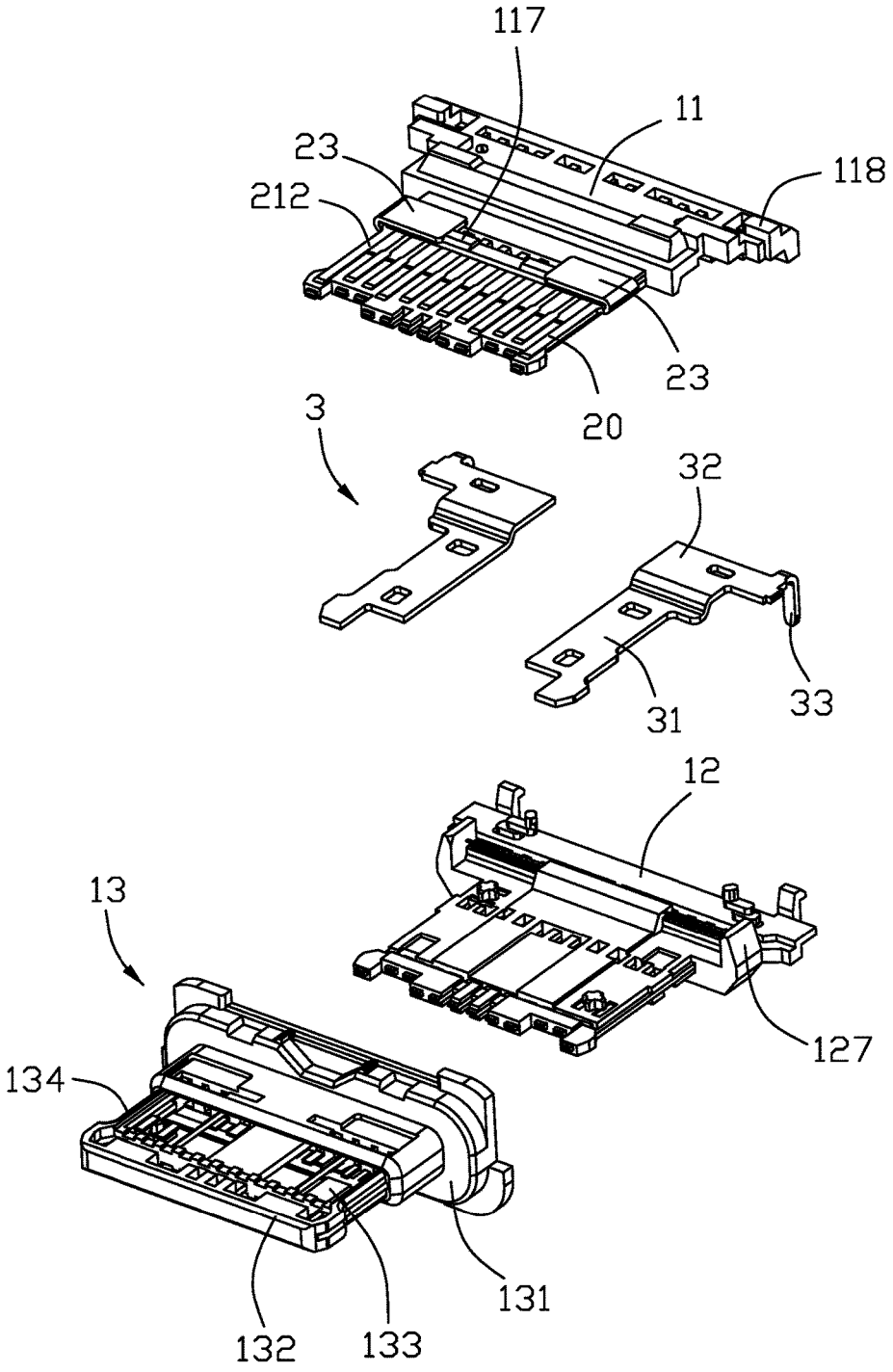
FIG. 9 is a further exploded view of FIG. 7.
Figure 10:
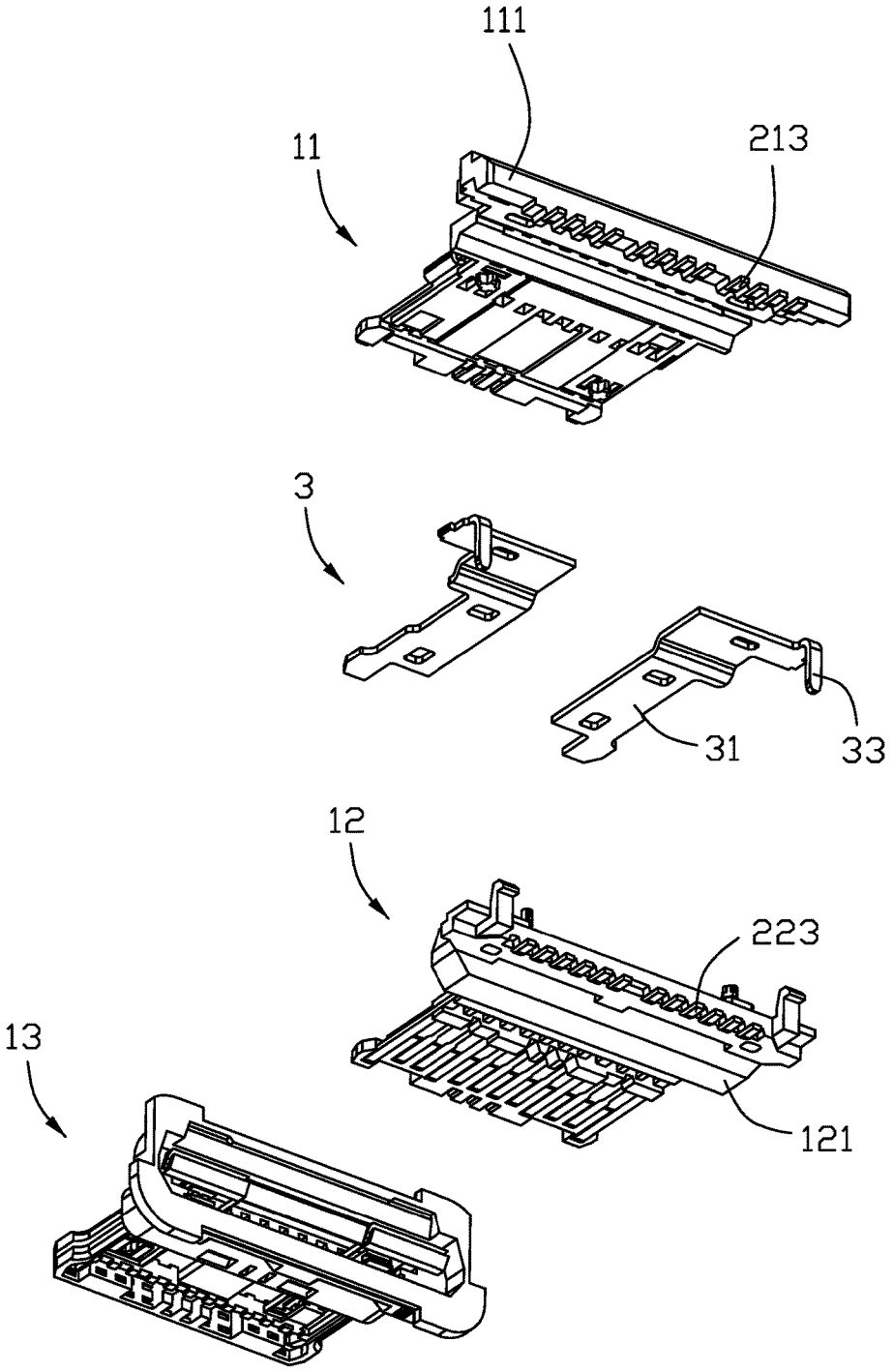
FIG. 10 is a view similar to FIG. 9 but from a different perspective.
Figure 11:
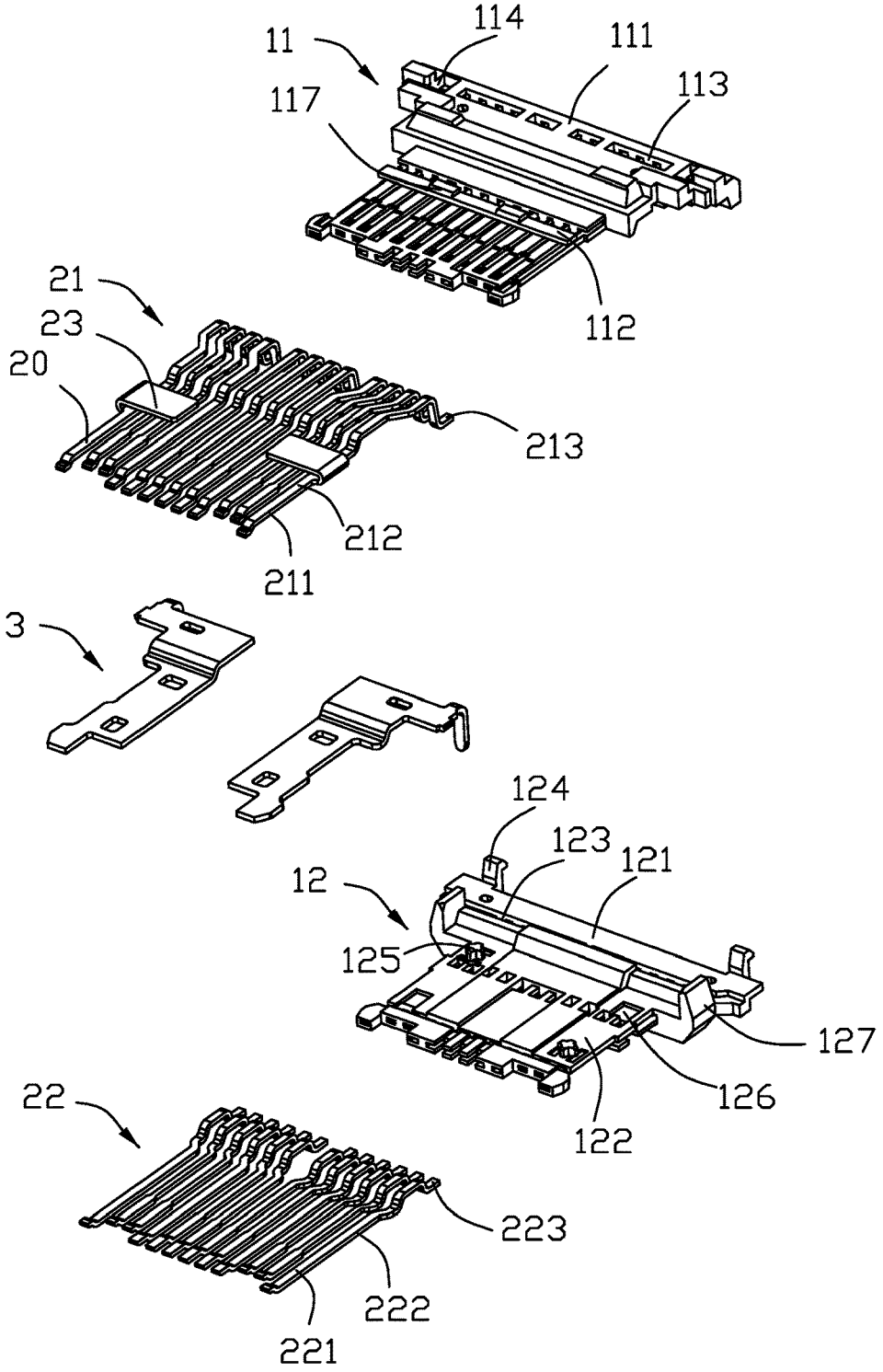
FIG. 11 is a further exploded view of FIG. 9 omitting an over-mold thereof.
Figure 12:
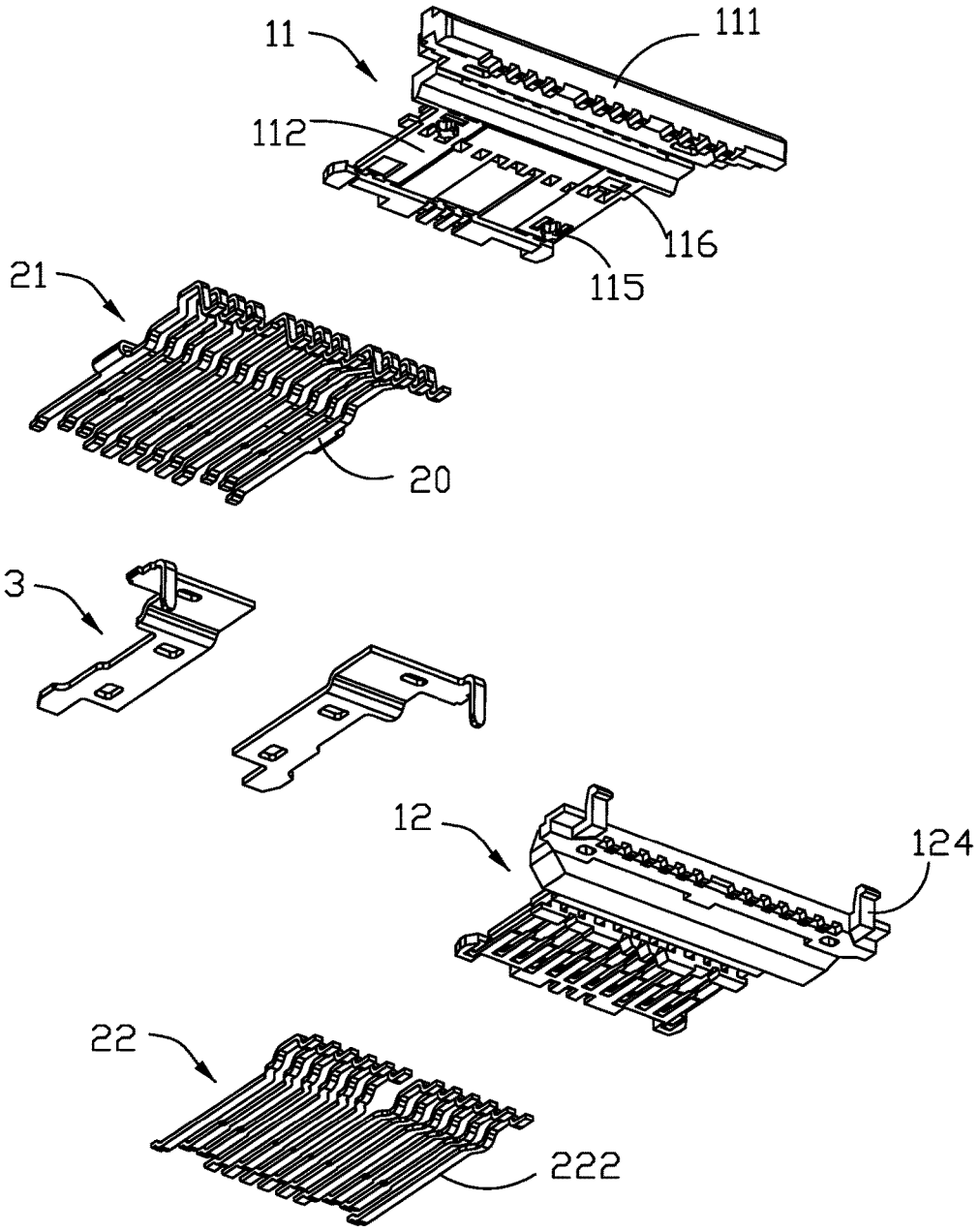
FIG. 12 is a view similar to FIG. 11 but from a different perspective.
Figure 13:
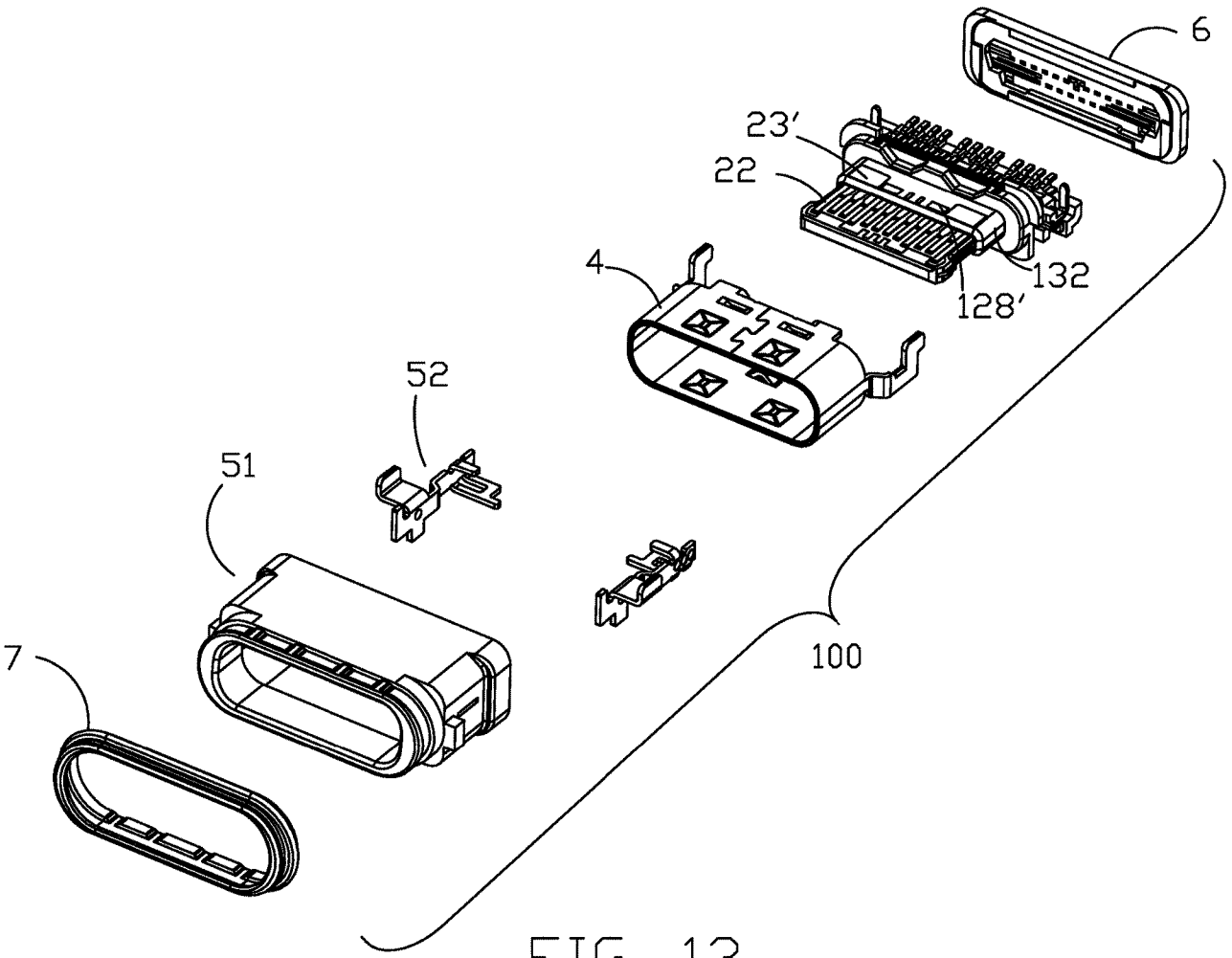
FIG. 13 is an exploded view of an electrical connector in accordance with a second embodiment of the present invention.
Figure 14:
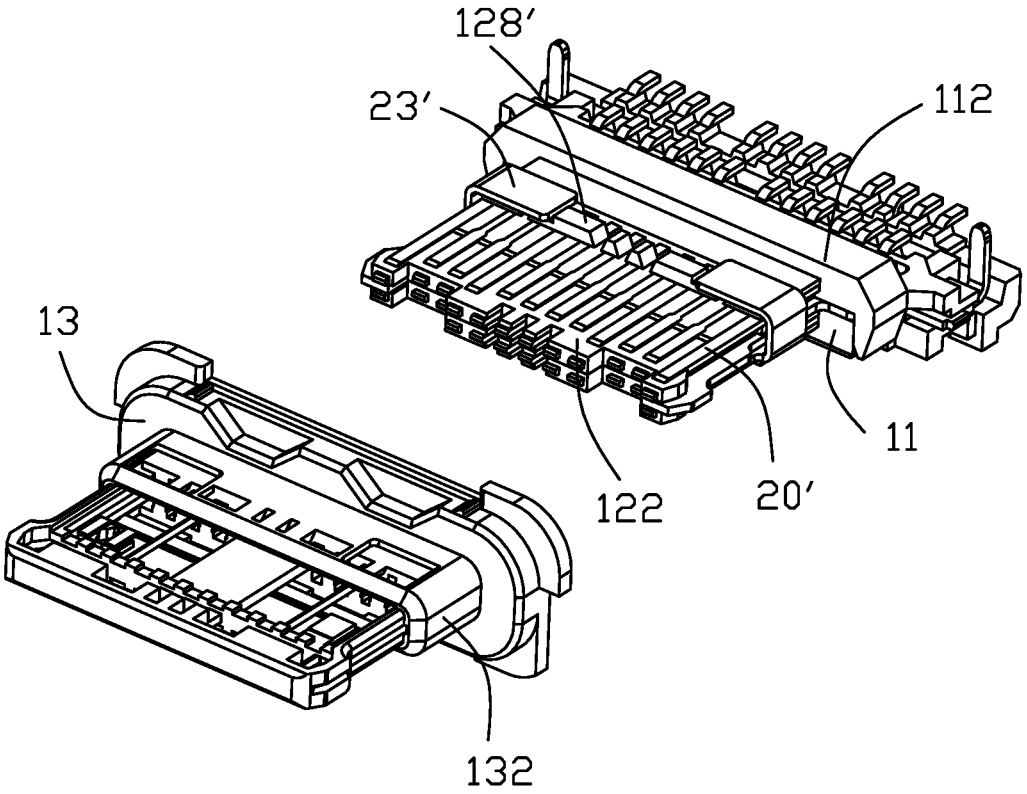
FIG. 14 is an exploded view of an insulative housing and a plurality of contacts of the electrical connector in FIG. 13.
Figure 15:
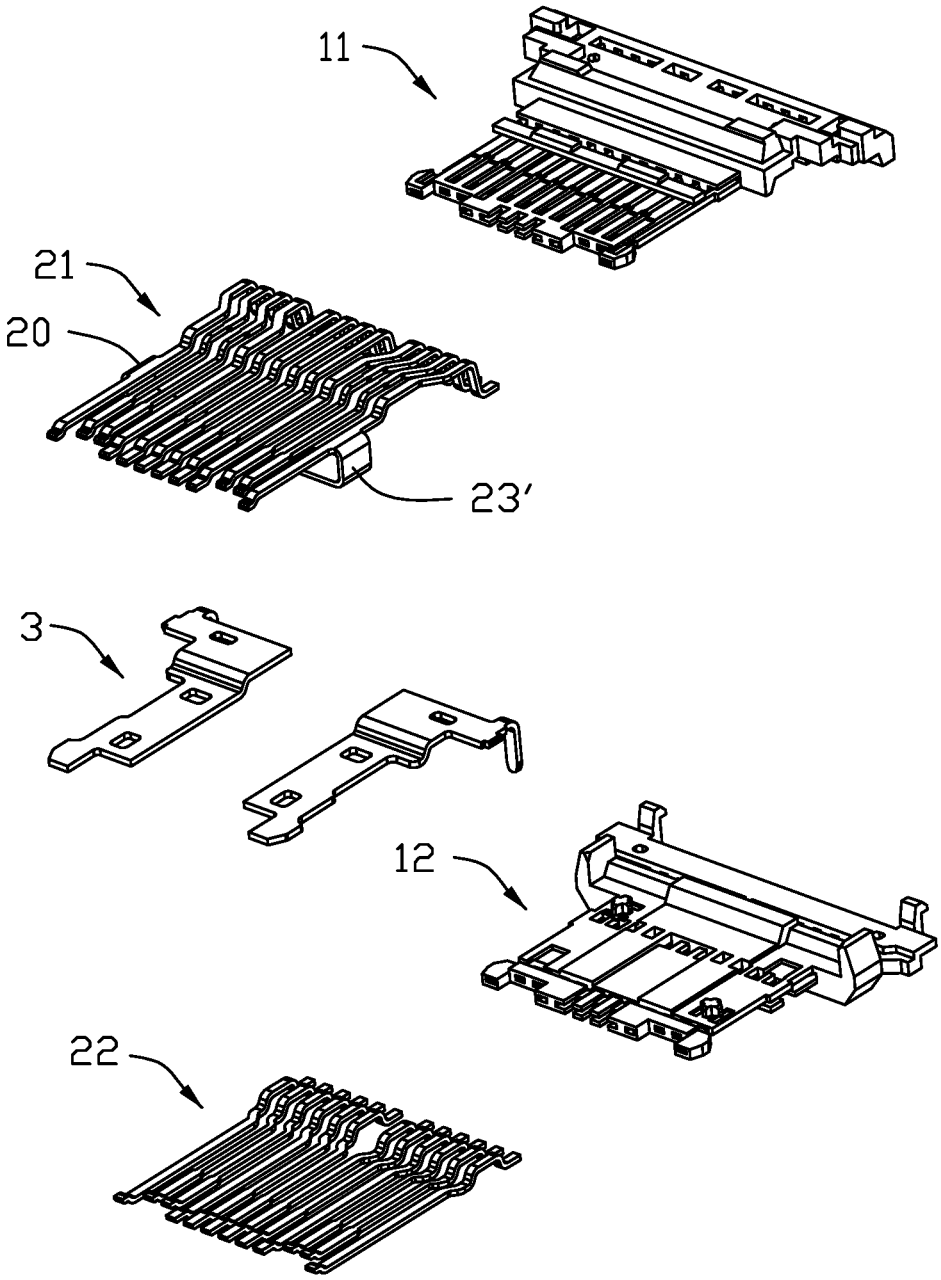
FIG. 15 is a further exploded view of FIG. 14 omitting an over-mold thereof.
Figure 16:
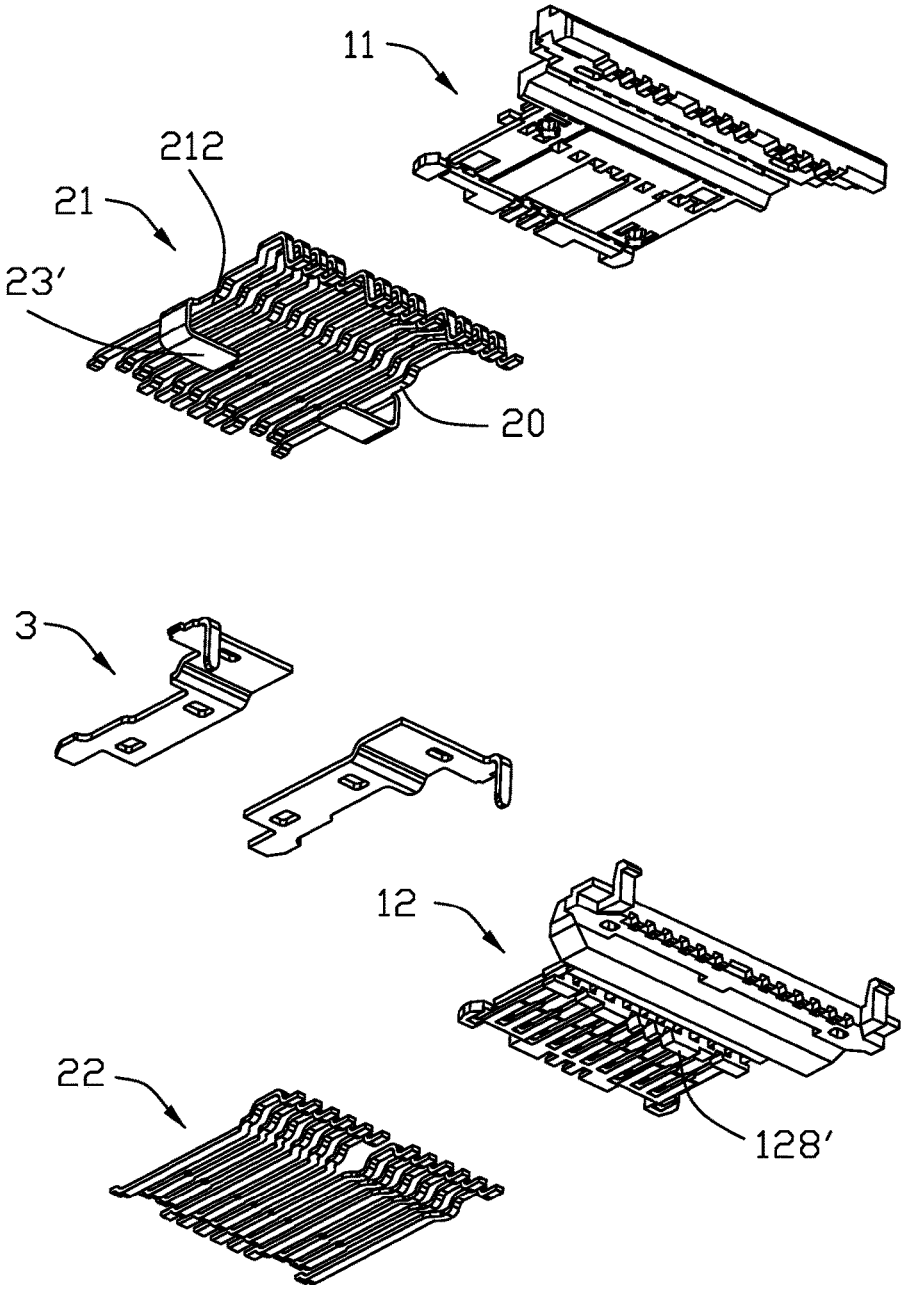
FIG. 16 is a view similar to FIG. 11 but from a different perspective.

Referring specifically to FIGS. 7-12, the insulative housing 1 is constructed of an upper body 11, a lower body 12, and an over-mold 13. The upper body 11 has a base part 111 and a tongue part 112. The base part 111 has a row of holes 113 and two apertures 114. As shown in FIG. 12, the tongue part 112 has at a lower surface thereof plural posts 115 and plural holes 116. As shown in FIG. 11, the tongue part 112 has at an upper surface thereof a pair of steps 117. Outwardly of the two apertures 114 there are two blocks 118, as shown in FIG. 9. The lower body 12 has a base part 121 and a tongue part 122. The base part 121 has holes 123 and two apertures hooks 124. As shown in FIG. 11, the tongue part 122 has at an upper surface thereof plural protrusion 125 for engaging the holes 116 and plural holes 126 for engaging the posts 115. The base part 121 has two clamps 127 for holding to the base part 111 of the upper body 11. The over-mold 13 has a base part 131 and a tongue part 132. As shown in FIGS. 7-10, the tongue part 132 has voids 133 and notches 134. The base parts 111, 121, and 131 constitute the base of the insulative housing 1 and the tongue parts 112, 122, and 132 constitute the tongue of the insulative housing 1.

The upper row of contacts 21 are secured to the upper body 11 and the lower row of contacts 22 are secured to the lower body 12. Each of the upper contacts 21 has a contacting portion 211, a soldering tail 213, and a connecting portion 212 therebetween. Each of the lower contacts 22 has a contacting portion 221, a soldering tail 223, and a connecting portion 222 therebetween. As shown in FIGS. 9 and 10, two outermost contacts of each row of contacts 21 or 22 are ground contacts exposed to outer sides. The upper row of contacts 21 are reverse-symmetrically arranged with respect to the lower row of contacts 22 to enable dual-orientation mating with a complementary connector.

Figure 5:
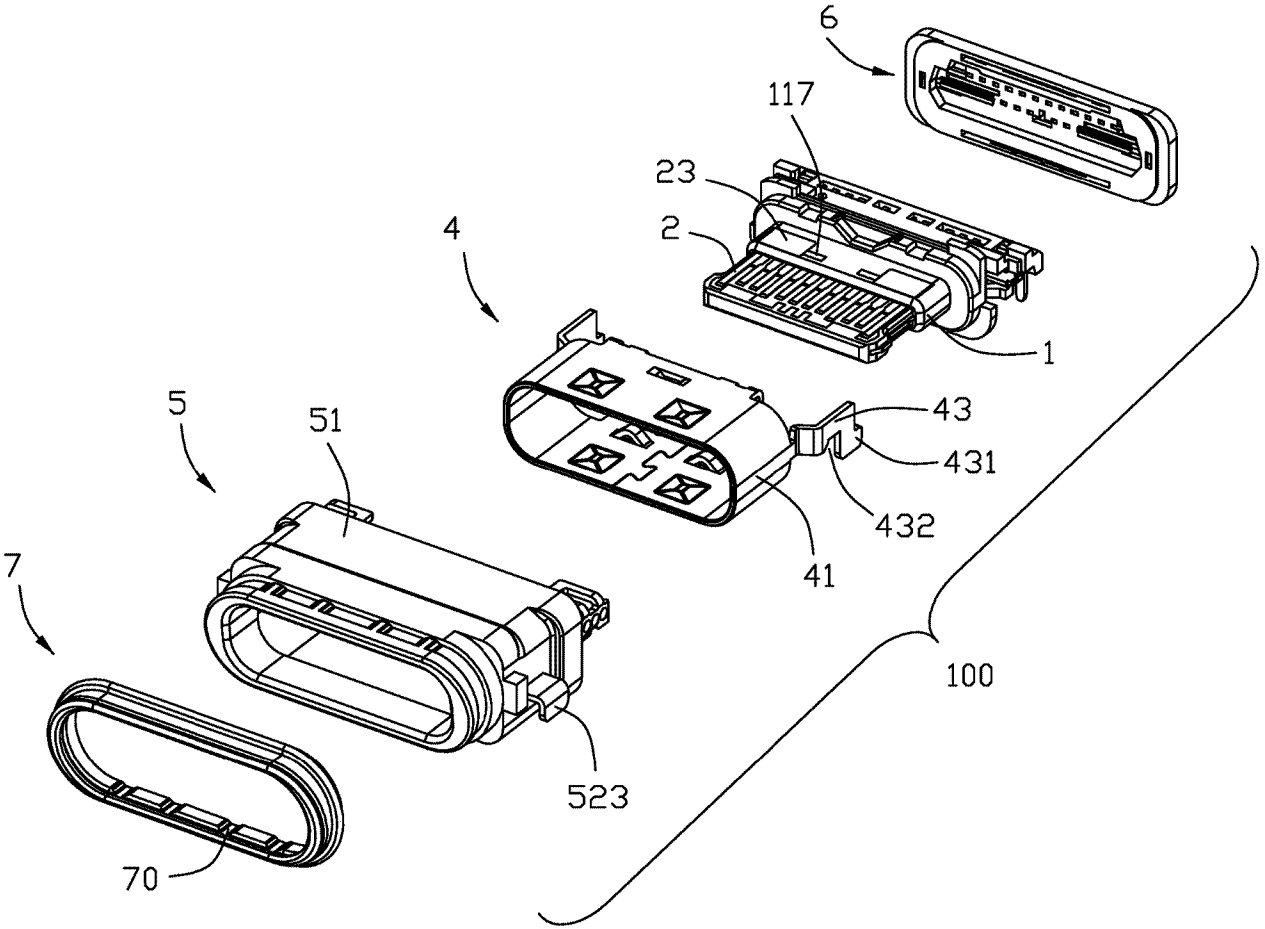
FIG. 5 is another exploded view of the electrical connector.
Figure 6:
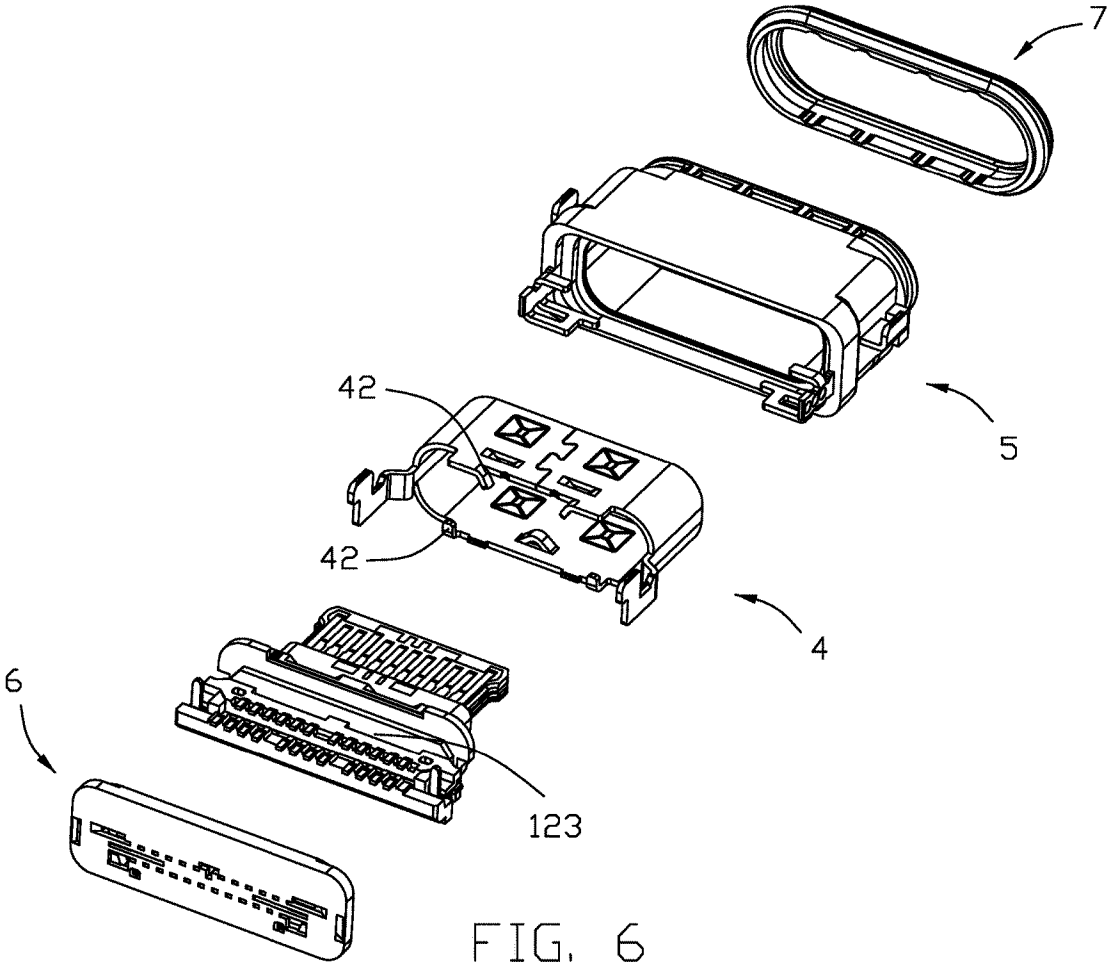
FIG. 6 is a view similar to FIG. 5 but from a different perspective.
Figure 7:
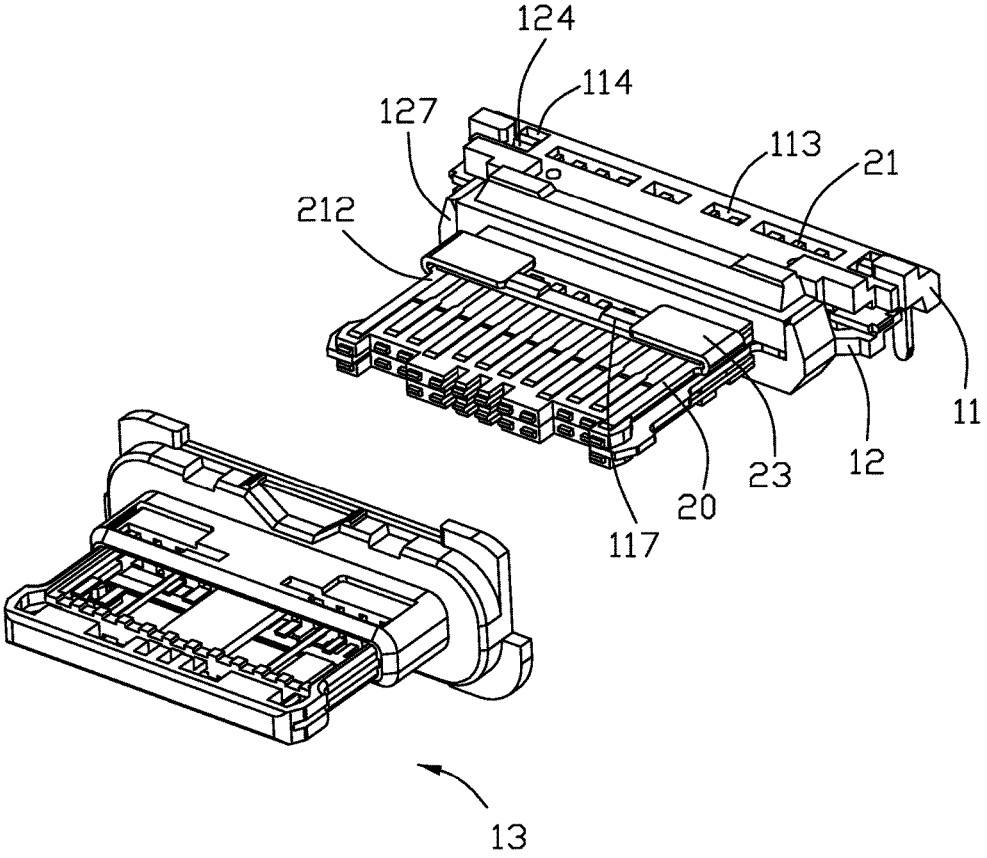
FIG. 7 is an exploded view of an insulative housing and a plurality of contacts of the electrical connector.
Figure 8:
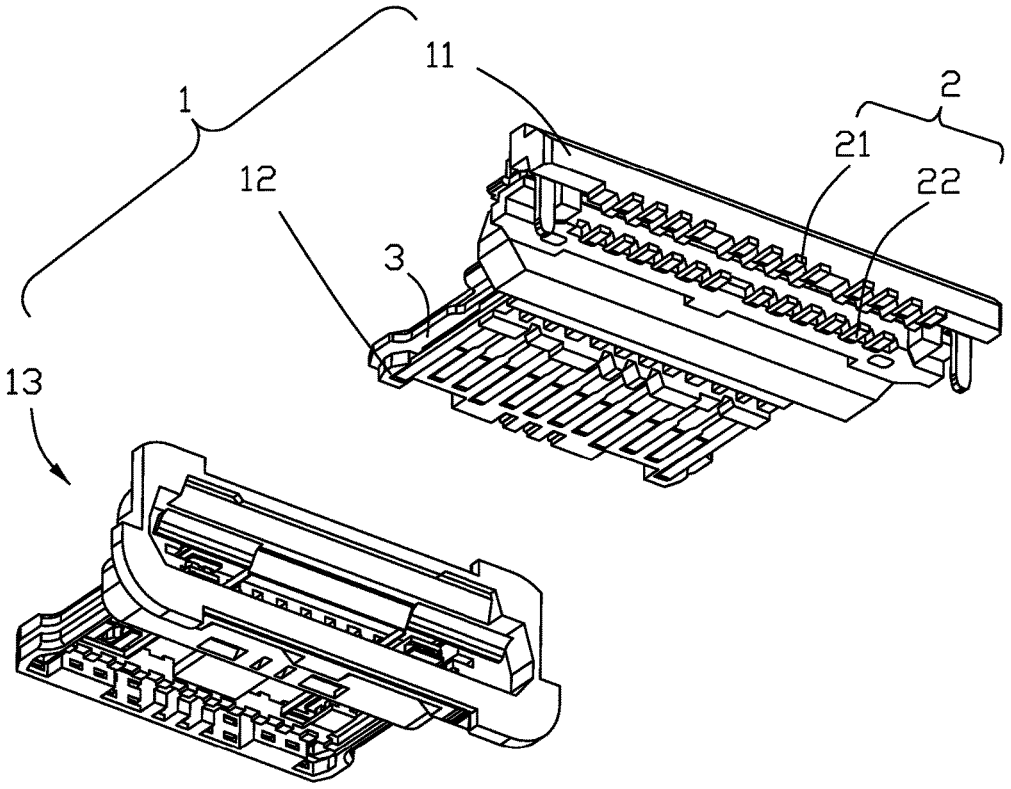
FIG. 8 is a view similar to FIG. 7 but from a different perspective.

Each of the two outermost ground contacts 20 of the upper row of contacts 21 has an extension 23 bent upwardly and inwardly from the connecting portion 212 up to the step 117. The extension 23 spans over at least two neighboring contacts 2. The tongue of the insulative housing 1 has a step exposing the extension 23. As shown in FIGS. 5, 7, and 9, the extension 23 is flush with the tongue 132 of the over-mold 13 so that a grounding piece of a complementary connector may stably contact the extensions 23 for a better grounding effect.

Referring specifically to FIGS. 9-12, the metal piece 3 has a front part 31, a rear part 32, and a leg 33.

Referring specifically to FIGS. 1-6, the shielding shell 4 includes a main part 41, plural stoppers 42 for abutting the insulative housing 1, and a pair of side arms 43 at rear sides of the main part. The side arm 43 has a leg 431 and a notch 432.

Figure 2:
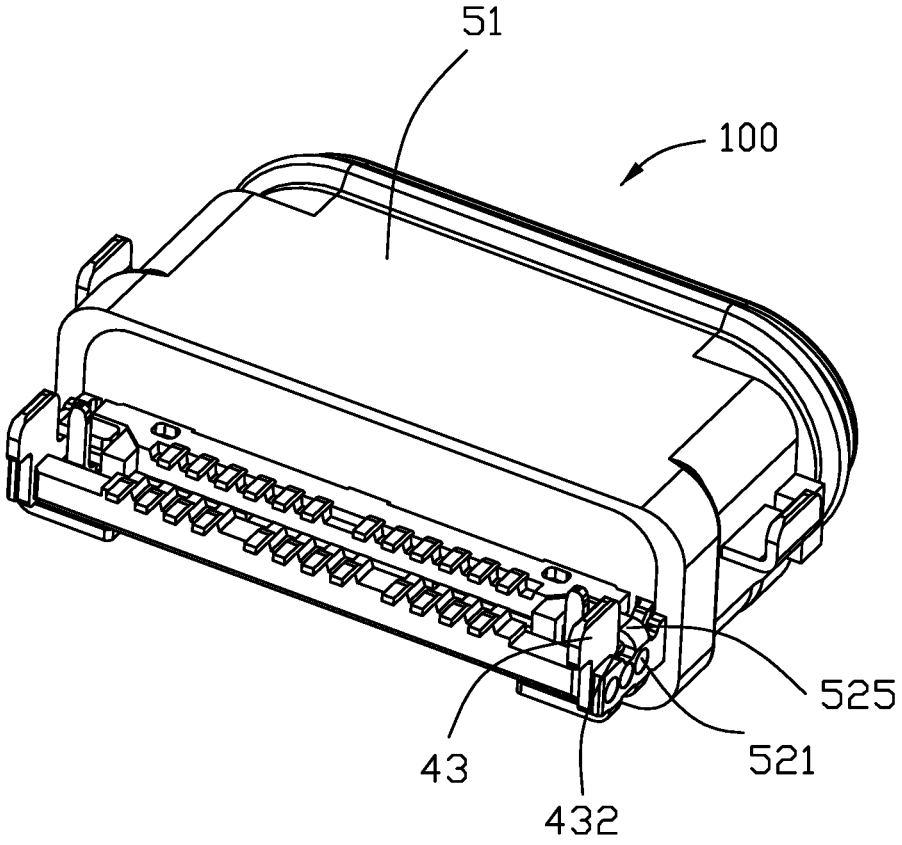
FIG. 2 is a view similar to FIG. 1 but from a different perspective.
Figure 3:
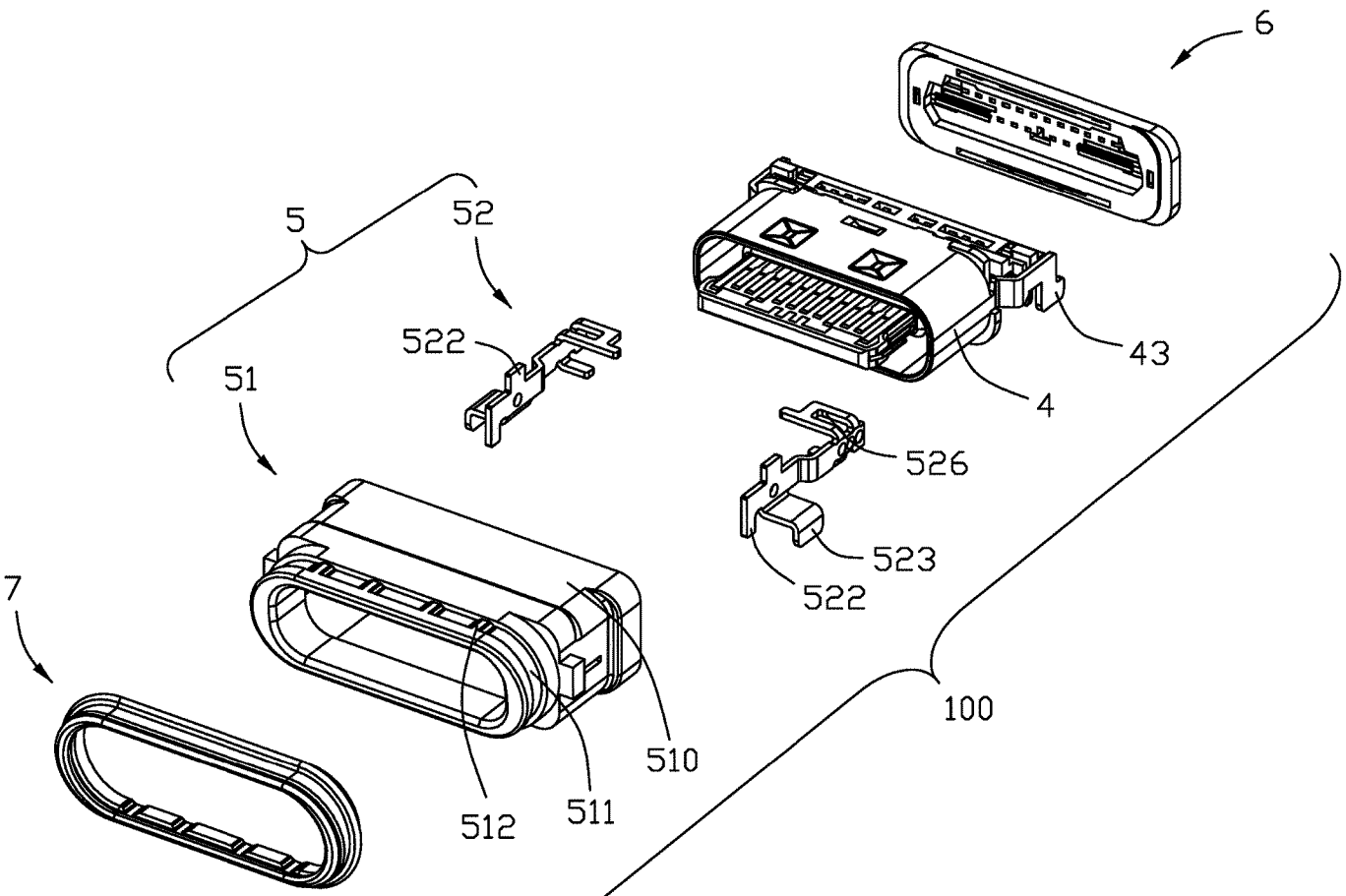
FIG. 3 is an exploded view of the electrical connector.
Figure 4:
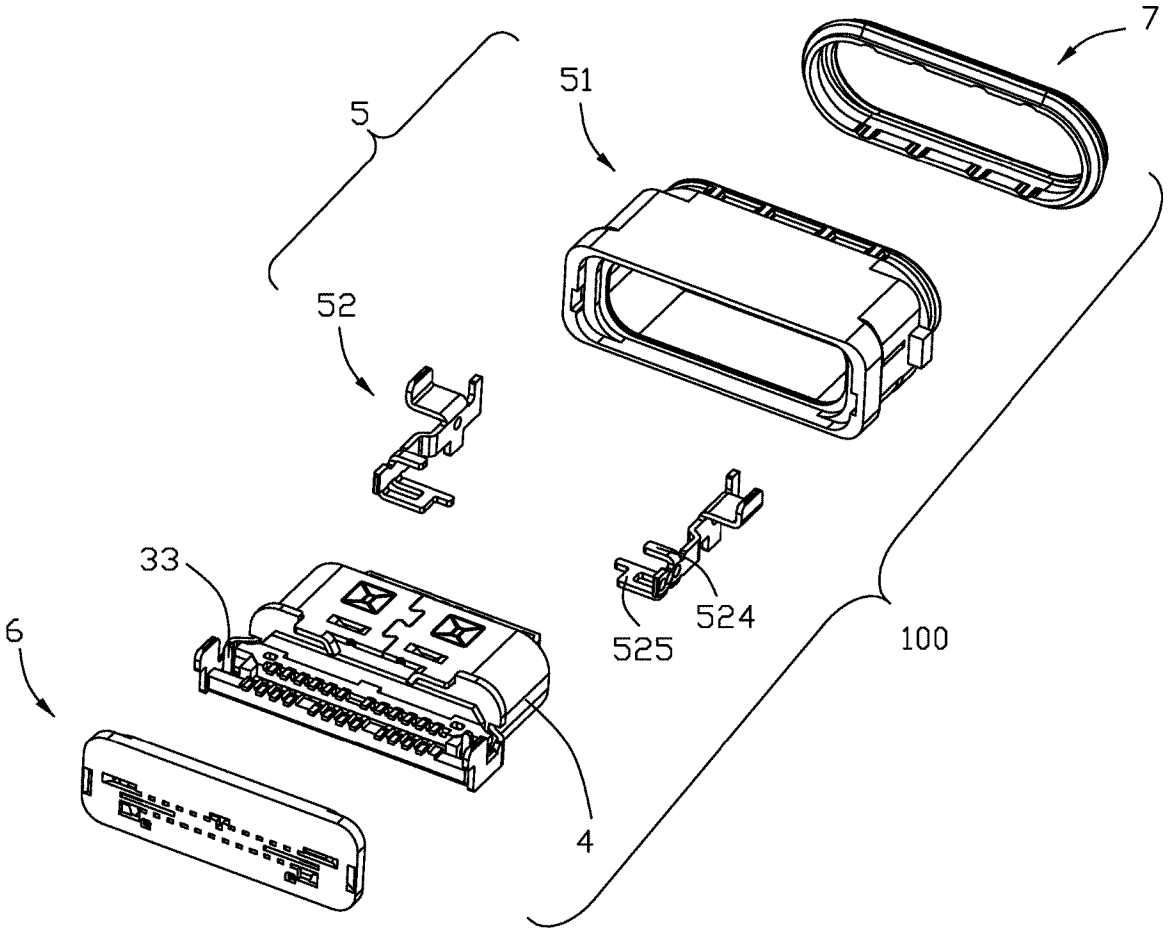
FIG. 4 is a view similar to FIG. 3 but from a different perspective.

Referring specifically to FIGS. 1-6, the outer cover 5 includes an insulative part 51 and a pair of metallic brackets 52 insert molded with the insulative part. The insulative part 51 has a tubular main portion 510. The main portion 510 has an annular recess 511 and dividers 512 in the groove 511. The bracket 52 includes a fixing arm 521, two abutting arms 522, a soldering leg 523, a securing portion 524, a pressing arm 525, and a hole 526. As shown in FIG. 2, the fixing arm 521 is spot welded to the side arm 43 of the shielding shell 4 and the pressing arm 525 extends through the notch 432 to abut a bottom of the insinuative housing 1. As shown in FIG. 1, the block 118 of the insinuative housing 1 extends through the hole 526 and abuts the securing portion 524.

Referring again to FIGS. 2-6, the sealing member 6 is formed by solidifying or curing suitable material in liquefied state and seals the holes 123 exposing the contacts 2 and the interface gap between the insulative housing 1 and the shielding shell 4.

Referring again to FIGS. 1-6, the sealing member 7 is formed by solidifying or curing suitable material in liquefied state onto the recess 511 and has channels 722 engaging the dividers 512.

FIGS. 13-16 show an electrical connector 100' according to a second embodiment which is different from the electrical connector 100 of the first embodiment only in that corresponding ground contact 20' of the upper row of contacts 21 has an extension 23' bent downwardly and inwardly. The downwardly bent extension 23' further obtains a firm combined structure of the upper body 11, the metal pieces 3, and the lower body 12. In brief, the feature of the invention is to provide the outermost grounding contact with an extension in a folded manner to be exposed upon the step wherein the first embodiment shows the extension extends away from the metal piece at the mid-level of the tongue part to be exposed upon the step while the second embodiment shows the extension extends toward and beyond the mid-level of the tongue part to be exposed upon the step.

What is claimed is:

1. An electrical connector comprising:

an insulative housing is constructed of an upper body, a lower body and an over mold, each having a base and a tongue;

an upper and lower rows of contacts secured to the upper body and the lower body and exposed respectively to an upper and lower surfaces of the tongues, each row of contacts including two outermost ground contacts; and a metallic shielding shell enclosing the contact module;

wherein at least one of the ground contacts in one or both rows of the contacts has an extension, and the tongue has on at least one of the upper and lower surfaces a step exposing the extensions;

wherein at least one of the ground contacts in the upper row of contacts has the extension, and the tongue has on the upper surface the step exposing the extension;

wherein a pair of metal pieces disposed between the upper row of contacts and the lower row of contacts;

wherein the ground contact has a contacting portion, a soldering tail, and an intermediate connecting portion, and the extension is bent from the connecting portion; and wherein the extension spans over at least two neighboring contacts.

2. The electrical connector as claimed in claim 1, wherein at least one of the ground contacts in the upper row of contacts has the extension, and the tongue has on the lower surface the step exposing the extension.

3. An electrical connector comprising:

an insulative housing is constructed of an upper body, a lower body and an over mold, each including a base part and a tongue part forwardly extending from the base part in a front-to-back direction, the tongue part forming opposite two surfaces in a vertical direction perpendicular to the front-to-back direction, and a step around a rear portion of the tongue part to be joined with the base; and a plurality of contacts disposed in the upper body and the lower body and including contacting sections exposed upon the corresponding surfaces, and including a pair of grounding contacts at two lateral sides in a transverse direction perpendicular to both said front-to-back direction and said vertical direction;

wherein each of said grounding contacts includes a lateral extending extension in a folded manner along the transverse direction to be exposed upon the step in the vertical direction;

wherein said extension extends toward and beyond a mid-level of the tongue part to be exposed upon the step;

wherein a pair of metal pieces disposed between the upper row of contacts and the lower row of contacts;

wherein the extension spans over at least two neighboring contacts; and wherein the contacting sections of the contacts are exposed upon surfaces of the tongue parts.

4. The electrical connector as claimed in claim 3, wherein said extension extends away from the mid-level of the tongue part to be exposed upon the step.

5. The electrical connector as claimed in claim 3, wherein the extension is hidden behind the housing in the transverse direction.

* * * * *